US011564518B2

(12) United States Patent
Barczyk

(10) Patent No.: US 11,564,518 B2
(45) Date of Patent: Jan. 31, 2023

(54) CUP HOLDER SYSTEM

(71) Applicant: Brian Barczyk, Warren, MI (US)

(72) Inventor: Brian Barczyk, Warren, MI (US)

( * ) Notice: Subject to any disclaimer, the term of this patent is extended or adjusted under 35 U.S.C. 154(b) by 0 days.

(21) Appl. No.: 17/500,290

(22) Filed: Oct. 13, 2021

(65) Prior Publication Data

US 2022/0211200 A1 Jul. 7, 2022

Related U.S. Application Data

(63) Continuation of application No. 16/570,387, filed on Sep. 13, 2019, now abandoned.

(60) Provisional application No. 62/730,657, filed on Sep. 13, 2018.

(51) Int. Cl.

| | |
|---|---|
| ***A47G 23/02*** | (2006.01) |
| ***B65D 25/28*** | (2006.01) |
| ***A45F 5/10*** | (2006.01) |

(52) U.S. Cl.

CPC ..... *A47G 23/0208* (2013.01); *A45F 5/102* (2013.01); *B65D 25/2802* (2013.01); *B65D 2525/285* (2013.01)

(58) Field of Classification Search

CPC . A47G 23/0208; A45F 5/102; B65D 25/2802; B65D 2525/285

USPC ..... 220/737, 738, 756, 23.4, 23.6

See application file for complete search history.

(56) References Cited

U.S. PATENT DOCUMENTS

| | | | | | |
|---|---|---|---|---|---|
| 2,153,391 | A * | 4/1939 | Projansky | A47G 23/0208 | 229/117.23 |
| 2,654,628 | A * | 10/1953 | Klante | A47G 23/0208 | 294/87.28 |
| 3,104,788 | A * | 9/1963 | Wood | A47G 23/0208 | D7/513 |
| 3,768,710 | A * | 10/1973 | Eggers | A47G 23/0208 | 294/143 |
| 3,966,102 | A * | 6/1976 | Clark | A47G 23/0208 | D7/706 |
| D292,157 | S * | 10/1987 | Robinson | D7/505 | |
| 4,860,896 | A * | 8/1989 | Snider | B65D 67/02 | 206/427 |
| 4,919,296 | A * | 4/1990 | Kirsh | B65D 21/0204 | 220/737 |
| 4,940,137 | A * | 7/1990 | Straub | B65D 71/50 | 206/139 |
| D322,025 | S * | 12/1991 | Funston | D8/382 | |
| 5,219,419 | A * | 6/1993 | Prothe | A47G 19/23 | 220/769 |
| 5,446,995 | A * | 9/1995 | Huber | A01G 9/027 | 220/23.4 |
| 5,971,139 | A * | 10/1999 | Bradley | A47G 19/06 | 206/217 |
| 6,520,366 | B1 * | 2/2003 | Bradley | A47G 19/065 | 220/23.6 |
| 6,606,996 | B1 * | 8/2003 | Thornell | A24F 19/0085 | 220/756 |

(Continued)

*Primary Examiner* — J. Gregory Pickett
*Assistant Examiner* — Niki M Eloshway
(74) *Attorney, Agent, or Firm* — Carlson, Gaskey & Olds, P.C.

(57) ABSTRACT

A beverage drinking device includes a body that supports a plurality of containers arranged relative to each other such that a liquid from a first one of the containers flows into an adjacent, second one of the containers while an individual consumes liquid from the second one of the containers.

16 Claims, 4 Drawing Sheets

(56) References Cited

U.S. PATENT DOCUMENTS

| | | | | |
|---|---|---|---|---|
| 6,684,458 | B1 * | 2/2004 | Sargant | A47J 45/067 16/425 |
| D583,193 | S * | 12/2008 | Kushner | D7/505 |
| 9,038,826 | B2 * | 5/2015 | Cocci | B65D 69/00 220/756 |
| 10,343,576 | B1 * | 7/2019 | Ortega Rojo | B60N 3/101 |
| 10,383,431 | B2 * | 8/2019 | Hancock | A47G 23/02 |
| 2003/0029878 | A1 * | 2/2003 | Peitzmeier | B60N 3/106 220/737 |
| 2004/0000550 | A1 * | 1/2004 | Taccolini | A47J 47/16 220/23.4 |
| 2007/0295738 | A1 * | 12/2007 | Hussain | B65D 1/265 220/737 |
| 2008/0128440 | A1 * | 6/2008 | Braams | A47G 23/0641 220/737 |
| 2012/0074155 | A1 * | 3/2012 | Yeung | B65D 23/106 220/737 |
| 2014/0014552 | A1 * | 1/2014 | Pokora | A47G 23/0208 220/737 |
| 2015/0257564 | A1 * | 9/2015 | Tong | A63H 33/102 220/737 |
| 2016/0227950 | A1 * | 8/2016 | Minevich | A47G 23/0208 |
| 2017/0071383 | A1 * | 3/2017 | Cook | A47G 23/0208 |
| 2018/0055260 | A1 * | 3/2018 | Capobianco | A47G 23/0208 |
| 2018/0220823 | A1 * | 8/2018 | Lawhon | A47G 23/0208 |
| 2019/0024970 | A1 * | 1/2019 | Sapia | F25D 31/008 |
| 2019/0335883 | A1 * | 11/2019 | Fisher | A45F 5/021 |
| 2020/0121106 | A1 * | 4/2020 | Tsao | A47G 23/0208 |

* cited by examiner

CUP HOLDER SYSTEM

CROSS REFERENCE TO RELATED APPLICATION

This application is a continuation of U.S. patent application Ser. No. 16/570,387, filed on Sep. 13, 2019, which claims priority to U.S. Provisional Application No. 62/730,657, filed on Sep. 13, 2018.

BACKGROUND

Cup holders, including cup holder systems that are intended to accommodate more than one fluid container (e.g., cups or glasses containing liquids), are not able to provide a single user the opportunity to drink from more than one of the fluid containers at the same time.

SUMMARY

In general terms, an embodiment of this invention is a new and improved beverage drinking device that allows an individual to drink the contents of multiple containers.

An illustrative example embodiment of a beverage drinking device includes a body that supports a plurality of containers arranged relative to each other such that a liquid from a first one of the containers flows into an adjacent, second one of the containers while an individual consumes the liquid from the second one of the containers.

In some example embodiments, the body and the containers are formed separately and the containers are selectively received by the body. In other example embodiments, the body and the containers are all part of a single-piece structure.

In some example embodiments, the containers are cups that are received into openings or receptacles in the body. While the cups are supported by the body their rims are staggered relative to each other and situated in different planes.

The body in some embodiments is formed as a single-piece structure. In other embodiments the body comprises multiple pieces that are selectively secured together.

The body in some embodiments includes a handle that facilitates raising the device into a position where an individual may consume liquid from at least one of the containers.

Various features and advantages of at least one disclosed example embodiment will become apparent to those skilled in the art from the following detailed description. The drawings that accompany the detailed description can be briefly described as follows.

DETAILED DESCRIPTION OF THE INVENTION

Figure 1:
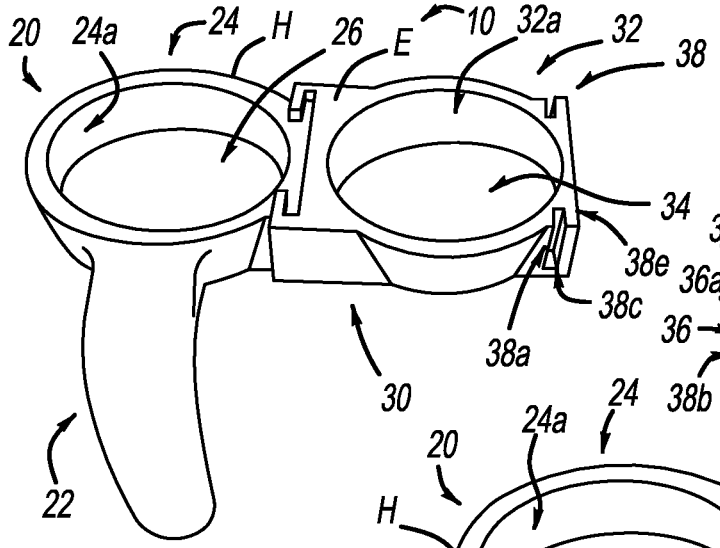
FIG. 1 is a perspective view of a beverage container holder system designed in accordance with an example embodiment of the present invention.
Figure 2A:
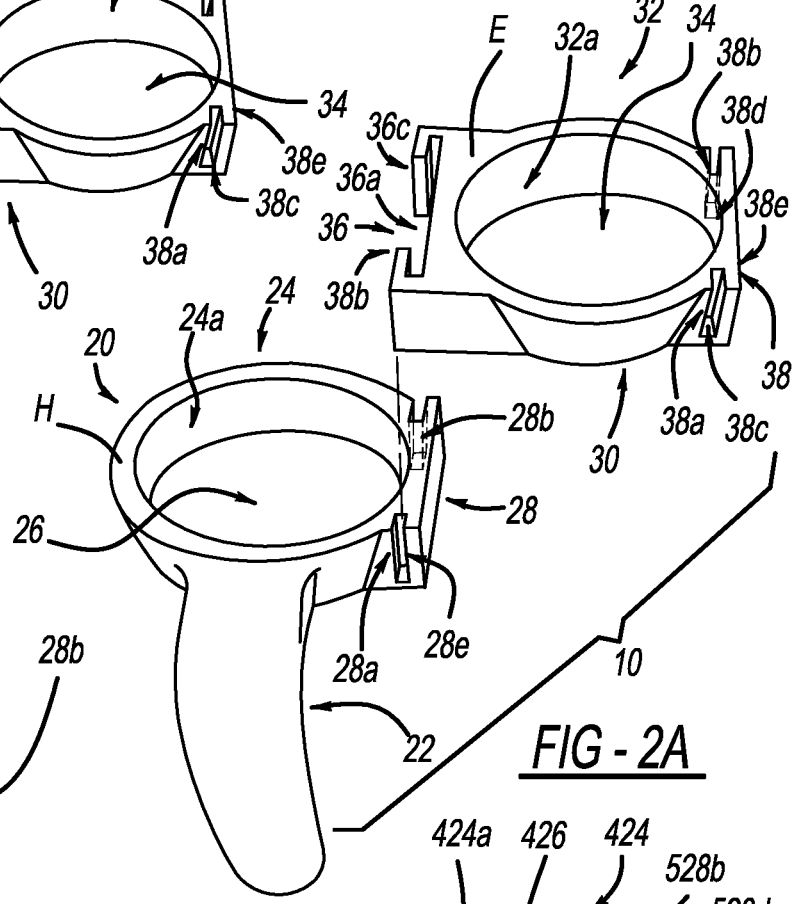
FIG. 2A is an exploded view of the system depicted in FIG. 1.
Figure 2B:
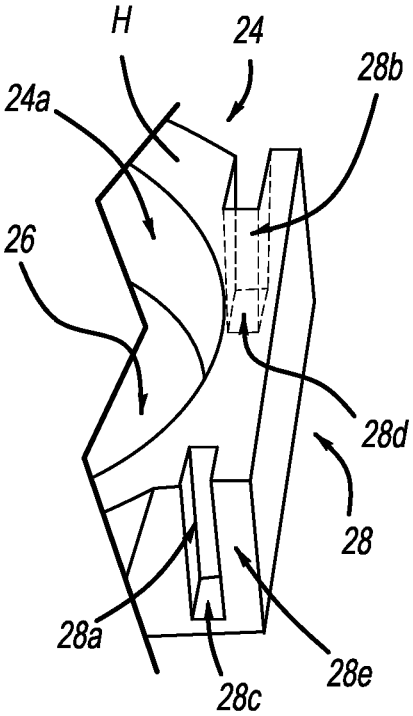
FIG. 2B is a detailed view of a portion of the handle unit of the system depicted in FIG. 2.

Referring to the Figures generally, and specifically to FIGS. 1-2B, a beverage container holder system 10 includes a handle unit 20 and at least one extension unit 30. The handle unit 20 and extension unit 30 are selectively operable to be brought into engagement with (and disengagement from) one another. The handle unit 20 may function as a first beverage container holder unit and the extension unit 30 may function as a second beverage container holder unit For discussion purposes, cups will be used as example beverage containers in the remainder of this description. Other fluid or beverage containers may be used in some embodiments or circumstances.

The example handle unit 20 includes a handle member 22 associated with a cup holder portion 24. The handle member 22 is configured to be grasped by a user to hold and manipulate the cup holder system 10. While the handle member 22 is shown on the right hand side of the handle unit 20, it should be appreciated that the handle member 22 could also be configured to be placed on the left hand side of the handle unit 20. Some embodiments include more than one handle member, such as one on each side of the handle unit 20.

Although the cup holder portion 24 includes a body or wall member 24*a* that is primarily circular in shape, it should be appreciated that the wall member 24*a* may include other shapes and configurations in other embodiments. The cup holder portion 24 includes an area defining an aperture 26 formed in a portion of the wall member 24*a*. In some examples, the aperture 26 may be circular (or other similar shape) in configuration to accommodate a large number of sizes of conventional fluid containers (e.g., cups, glasses and/or the like).

At least one attachment member 28 may be formed on an outer surface of the wall member 24*a*. The attachment member 28 includes at least one area defining a groove 28*a* and, optionally, may include a second spaced and opposed area defining a second groove 28*b*. In some examples, the grooves 28*a*, 28*b*, respectively, may not extend all the way through the wall member 24*a*, but rather may only extend partially into the wall member 24*a* to define a floor surface 28*c*, 28*d*, respectively, on either or both of the grooves 28*a*, 28*b*, respectively. In some examples, the grooves 28*a*, 28*b*, respectively, may define a partial (or full) boss or flange 28*e* that is formed on the wall member 24*a*.

The extension unit 30 includes a cup holder portion 32. Although the cup holder portion 32 includes a body or wall member 32*a* that is primarily rectangular in shape, it should be appreciated that the wall member 32*a* may include other shapes and configurations as well. The cup holder portion 32 includes an area defining an aperture 34 formed in a portion of the wall member 32*a*. In some examples, the aperture 34 may be circular (or other similar shape) in configuration so at accommodate a large number of sizes of conventional fluid containers (e.g., cups, glasses and/or the like).

At least one attachment member 36 may be formed on an outer surface of the wall member 32*a*. The attachment member 36 includes at least one area defining a groove 36*a*. In some examples, the groove 36*a* may extend all the way through the wall member 32*a*. In some examples, the groove 36*a* may define one or more full (or partial) bosses or flanges 36*b*, 36*c*, respectively, that are formed on the wall member 32*a*.

At least one other attachment member 38 may be formed on another portion of the outer surface of the wall member 32*a*, such that the other attachment member 38 is spaced and opposed from the first attachment member 36. The attachment member 38 includes at least one area defining a groove 38*a* and, optionally, may include a second spaced and opposed area defining a second groove 38*b*. In some examples, the grooves 38*a*, 38*b*, respectively, do not extend all the way through the wall member 32*a* and define a floor surface 38*c*, 38*d*, respectively, on either or both of the grooves 38*a*, 38*b*, respectively. In some examples, the grooves 38*a*, 38*b*, respectively, define a partial (or full) boss or flange 38*e* that is formed on the wall member 32*a*.

In order to couple the handle unit 20 to the extension unit 30, the corresponding attachment members 28, 36, are engaged together. This may be accomplished by engaging the grooves 28*a*, 28*b*, respectively, with the flanges 36*b*, 36*c*, respectively, for example, by lowering the attachment member 36 of the extension unit 30 downwardly onto the attachment member 28 of the handle unit 20. Conversely, this may also be accomplished by engaging flange 28*e* with groove 36*a*, for example, by lowering the attachment member 36 of the extension unit 30 downwardly onto the attachment member 28 of the handle unit 20. Regardless of the methodology used to secure the units together, it should be appreciated that flanges 36*b*, 36*c*, respectively, are received within grooves 28*a*, 28*b*, respectively, in a manner so that a top surface E of the extension unit 30 is in a different plane than a top surface H of the handle unit 20 when the two units are coupled together. In the illustrated example, the top surface E is higher than the top surface H. In some examples, the presence of the floor surfaces 28*c*, 28*d*, respectively, prevent the flanges 36*b*, 36*c*, respectively, from being fully received within grooves 28*a*, 28*b*, respectively.

Decoupling the handle unit 20 from the extension unit 30 is simply accomplished by reversing the method of coupling these two units together.

Figures 3, 4:
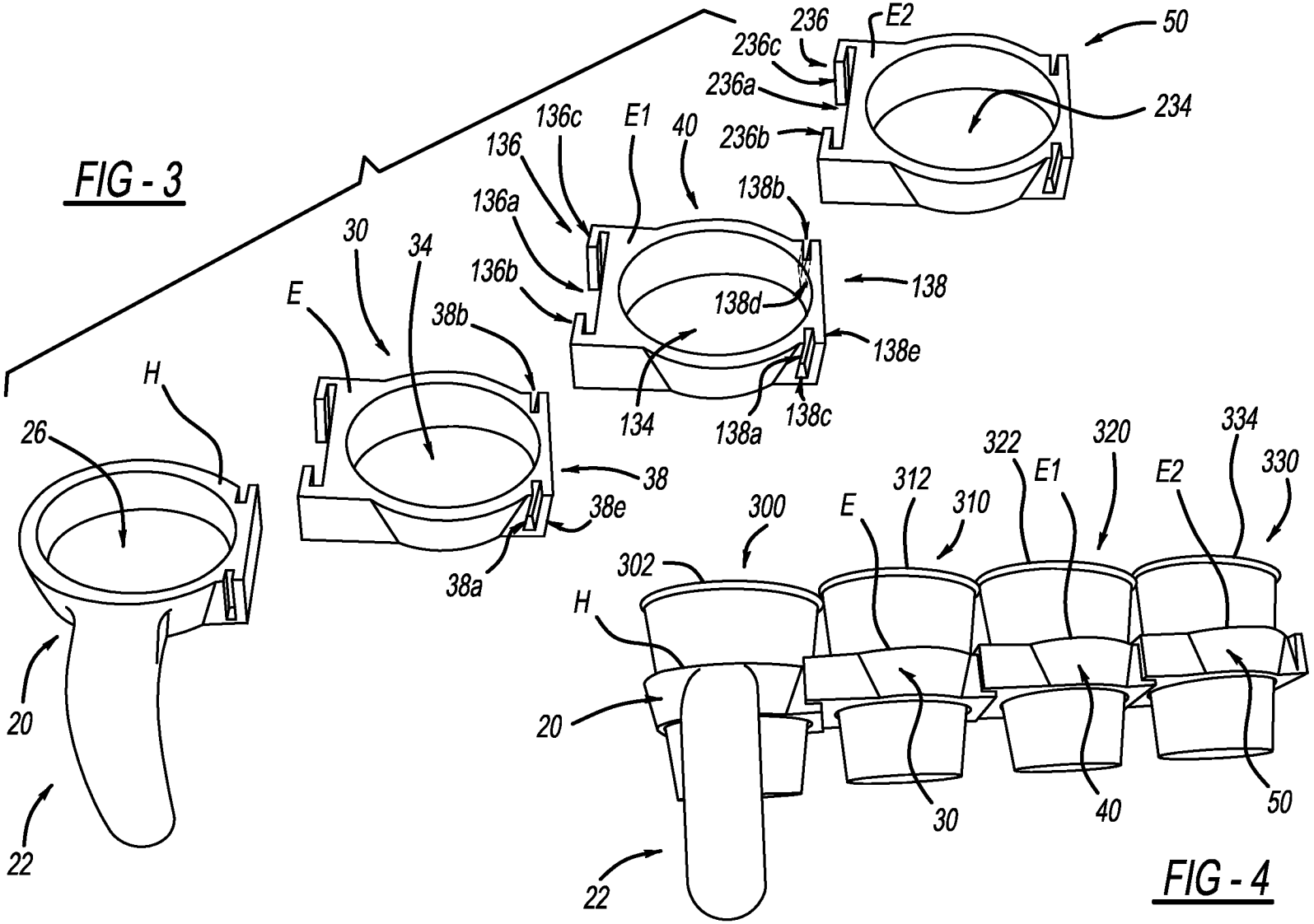
FIG. 3 is an exploded view of a beverage container holder system like that shown in FIG. 2 with additional container holders.
FIG. 4 is a perspective view of the system depicted in FIG. 3 with beverage containers.

Referring to FIGS. 3 and 4, the illustrated example accommodates additional extension units that may be added to the original or existing extension unit 30 that has been coupled to the handle unit 20. While two additional extension units 40, 50, are shown it should be appreciated that less than or more than this number of extension units may be used in the practice of the present invention. It should also be appreciated that the extension units 40, 50 are essentially identical in form and function as that of extension unit 30.

In order to couple extension unit 30 to extension unit 40, their respective attachment members 38, 136, are engaged together. This may be accomplished by engaging the grooves 38*a*, 38*b*, respectively, with the flanges 136*b*, 136*c*, respectively. Conversely, this may also be accomplished by engaging flange 38*e* with groove 136*a*. Regardless of the methodology used, it should be appreciated that flanges 136*b*, 136*c*, respectively, are received within grooves 38*a*, 38*b*, respectively, in a manner so that a top surface E1 of the extension unit 40 is in a different plane than (and, according to the illustration, slightly raised above) a top surface E of the extension unit 30 when the two units are coupled together. In some examples, the presence of the floor surfaces 38*c*, 38*d* control the positions of the flanges 136*b*, 136*c* within grooves 38*a*, 38*b*, respectively, and that controls the relative positions and orientations of the corresponding, adjacent extension units.

In order to couple extension unit 40 to extension unit 50, their respective attachment members 138, 236, are engaged together. This may be accomplished by engaging the grooves 138*a*, 138*b*, respectively, with the flanges 236*b*, 236*c*, respectively. Conversely, this may also be accomplished by engaging flange 138*e* with groove 236*a*. The manner in which the flanges 236*b*, 236*c*, respectively, are positioned within grooves 138*a*, 138*b* controls the spatial relationship between top surface E2 of the extension unit 50 and the top surface E1 of the extension unit 40 when the two units are coupled together. In some examples, the presence of the floor surfaces 138*c*, 138*d* and the length or height of the flanges 236*b*, 236*c*, respectively, controls the relative positions of the extension units.

It should be noted that additional extension units can be added to extension unit 50 and so on and so on until a practical limit (e.g., weight) of the total number of extension units is reached for the particular user.

Referring specifically to FIG. 4, a plurality of fluid containers 300, 310, 320, 330, respectively, are shown disposed in respective apertures 26, 34, 134, 234. It should be noted that a dispensing surface of each fluid container is in a different plane than that of an adjacent fluid container when those containers are received in the respective apertures. In the illustrated example embodiment, the dispensing surface is the open top or rim of each cup. As shown in the example of FIG. 4, the rim of an adjacent cup to the left is slightly raised above the rim of the next adjacent cup. That is, a top surface (e.g., a rim) of fluid container 310 is slightly above a top surface (e.g., a rim) of fluid container 300, a top surface (e.g., a rim) of fluid container 320 is slightly above a top surface (e.g., a rim) of fluid container 310, and a top surface (e.g., a rim) of fluid container 330 is slightly above a top surface (e.g., a rim) of fluid container 320. Although the top surfaces or rims, 302, 312, 322, 334, respectively, of the fluid containers 300, 310, 320, 330, respectively, are shown as abutting or overhanging an adjacent rim, it should be appreciated that the present invention may be practiced by having the rims, 302, 312, 322, 334 of the fluid containers 300, 310, 320, 330, respectively, in close proximity to one another without having to abut or overhang one another.

In this manner, the fluid containers 300, 310, 320, 330, respectively, are arranged in a cascading configuration such that fluid F in a first one of the containers flows into a second one of the containers when an individual consumes the fluid F from the second one of the containers. In the illustrated example of FIG. 7, when a user lifts or otherwise manipulates the system 10 upwardly to drink from the cup 300, fluid F contained in the cup 310 (a first container) may cascade into the cup 300 (a second container). In this example including more than two containers, as the user drinks from the cup 300, the fluid F in container 330 may cascade into fluid container 320, the fluid contained in fluid container 320 may cascade into fluid container 310, the fluid contained in fluid container 310 may cascade into fluid container 300.

In this manner, the cup holder system 10 of the present invention allows an individual user to consume a beverage from multiple cups in succession. The cup holder system 10 may be used, for example, as part of a game in which individuals compete against each other to see how many total cups each is capable of lifting and consuming while minimizing how much of the beverage spills. Such games may test the competitors' strength, dexterity and ability to consume large amounts of fluid quickly.

Figure 5:
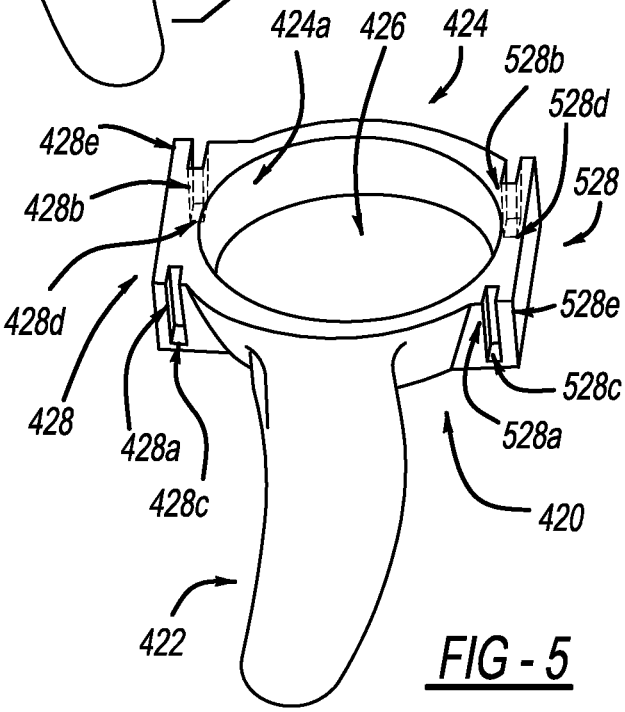
FIG. 5 is a perspective view of an alternative configuration of a handle unit.

Referring specifically to FIG. 5, an alternative handle unit 420 includes a handle member 422 associated with a cup holder portion 424. The handle member 422 is configured such that a user may grip either the right hand side of the handle unit 420 (presumably if the user is right-handed) or the left hand side of the handle unit 420 (presumably if the user is left-handed) easily by appropriately rotating the handle unit 420 to suit the needs of the user. In this manner, the handle unit 420 provides for ambidextrous use by either right-handed or left-handed users. Selecting either side of the handle unit 420 to which extension units are connected allows the user to customize whether the system 10 is right-handed or left-handed.

At least one attachment member 428 on an outer surface of the wall member 424*a* includes at least one area defining grooves 428*a* and 428*b* like the grooves on the holder unit 20 shown in FIGS. 1-4. The grooves 428*a*, 428*b* include a floor surface 428*c*, 428*d*, respectively. In some examples, the grooves 428*a*, 428*b*, respectively, may define a partial (or full) boss or flange 428*e* that is formed on the wall member 424*a*.

At least one other attachment member 528 may be formed on an outer surface of the wall member 424*a* spaced and opposed from attachment member 428. The attachment member 528 includes at least one area defining a groove 528*a* and, optionally, may include a second spaced and opposed area defining a second groove 528*b*. The example grooves 528*a*, 528 define a floor surface 528*c*, 528*d*, respectively. In some examples, the grooves 528*a*, 528*b*, respectively, may define a partial (or full) boss or flange 528*e* that is formed on the wall member 524*a*.

Figure 6:
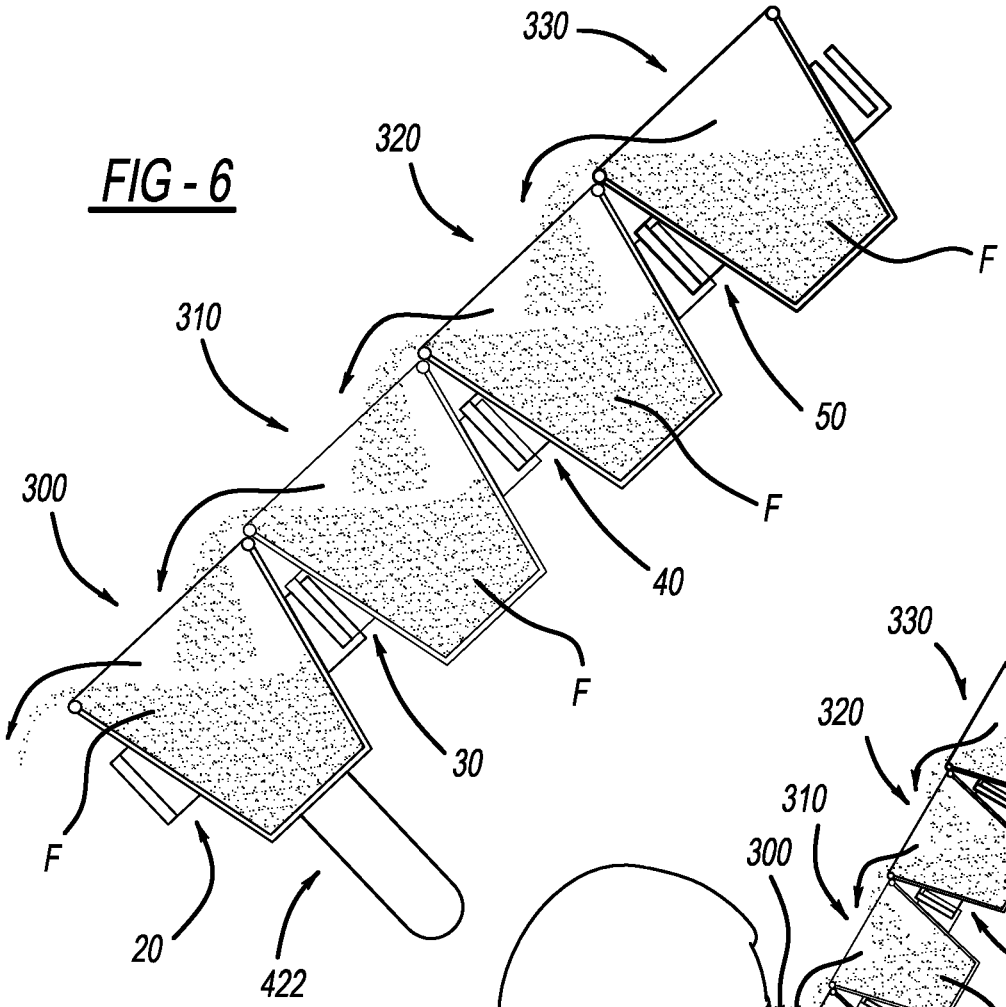
FIG. 6 schematically illustrates an example use of an example embodiment.
Figure 7:
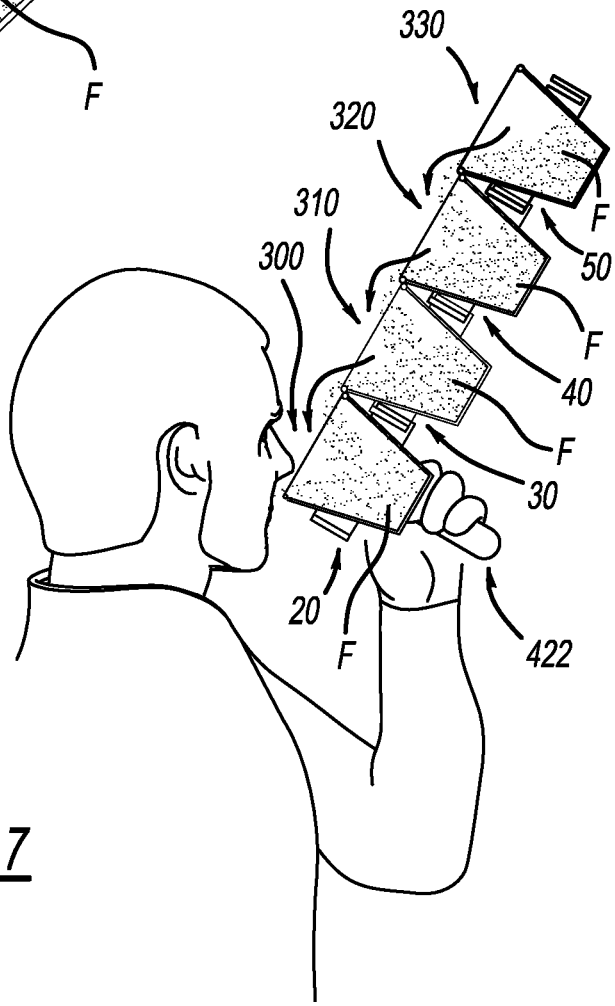
FIG. 7 illustrates an individual using the example embodiment of FIG. 6.

In this manner, either one of the respective attachment members 428, 528, respectively, may be coupled with the attachment member 36 of an extension unit 30 to permit users of either hand to utilize the cup holder system 10. For example, FIGS. 6-7 show the handle unit 420 in the "left-handed" configuration.

Figure 8:
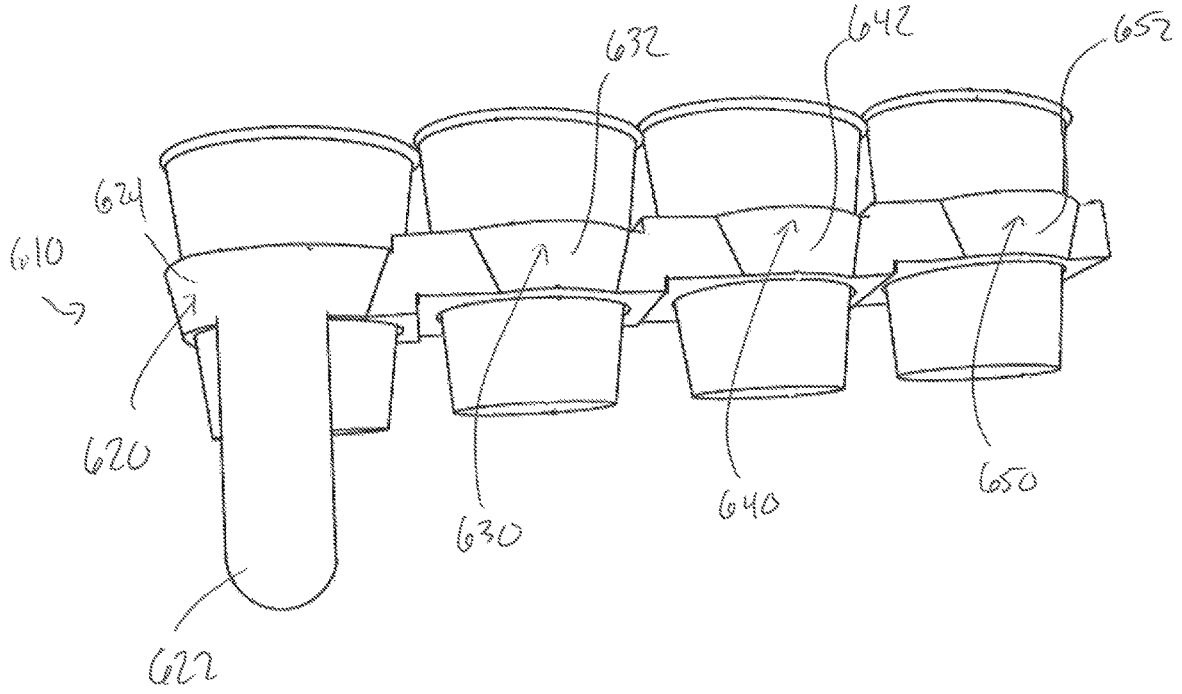
FIG. 8 is a perspective view of another beverage container holder system.

FIG. 8 illustrates an example cup holder system 610 similar to the cup holder system of FIG. 4, except that the cup holder portions 624, 632, 642, and 652 are all formed as part of a single-piece device. In this example, the body of the system 610 is monolithic. That is, the cup holder portion 624 and extension units 630, 640, and 650 are formed integrally as a single-piece structure and do not require individual pieces to be assembled together. In the example shown, the handle member 622 is part of the single-piece structure. For example, the handle member 622, the cup holder portion 624 and extension units 630, 640, and 650 are all molded together as a single piece. Although three extension units 630, 640, and 650 are shown in the example, more or fewer extension units may be monolithic with the handle unit 620.

In some embodiments, the system 10 includes receptacles for the fluid or beverage and separate cups are not required. For example, instead of including apertures for receiving cups or other containers, each unit of the system 10 may have an integrally formed cup-shaped receptacle formed as part of the device.

Although different embodiments are illustrated as having specific components or steps, the embodiments of this disclosure are not limited to those particular combinations. It is possible to use some of the components or features from any of the embodiments in combination with features or components from any of the other embodiments. Although a particular component arrangement is disclosed and illustrated in the exemplary disclosed embodiments, other arrangements are possible.

The preceding description is exemplary rather than limiting in nature. Variations and modifications to the disclosed examples may become apparent to those skilled in the art that do not necessarily depart from the essence of this disclosure. Thus, the scope of legal protection can only be determined by studying the following claims.

I claim:

1. A beverage drinking device comprising a body and a plurality of containers supported by the body, the plurality of containers all being arranged in a single straight line with each other, wherein the body has a configuration that positions a dispensing surface of a first one of the containers in a first plane and a dispensing surface of a second one of the containers in a second, different plane with a portion of the dispensing surface of the first one of the containers situated above and overlapping an adjacent portion of the dispensing surface of the second one of the containers establishing a cascading flow path in a direction parallel to the line for a liquid to flow from the first one of the containers into the second one of the containers while an individual tilts the body in a direction that is parallel to the line and consumes liquid from the second one of the containers.

2. The device of claim 1, comprising a handle extending from the body near at least one of the containers.

3. The device of claim 1, wherein the body comprises a plurality of apertures configured to receive and support the plurality of containers.

4. The device of claim 3, wherein the body comprises a plurality of units; and each of the units includes at least one of the apertures.

5. The device of claim 4, wherein the plurality of units are selectively connected together or separated from each other.

6. The device of claim 3, wherein the body is a single-piece structure including all of the plurality of apertures.

7. The device of claim 1, wherein the body comprises a plurality of units;

at least one of the units includes at least one attachment member;

at least one other of the units includes at least one groove configured to receive the at least one attachment member for connecting the at least one of the units to the at least one other of the units; and the at least one groove or the at least one attachment member includes a feature that situates a top surface of the one of the units in a third plane and a top surface of the one other of the units in a fourth, different plane.

8. The device of claim 1, wherein the body and the plurality of containers are integrally formed as a single-piece structure.

9. A method of using the beverage drinking device of claim 1, the method comprising:

grasping a handle portion of the body when the first one of the containers and the second one of the containers are at least partially filled with a beverage;

positioning the second one of the containers adjacent a mouth; and tilting the body along the line to simultaneously (i) cause at least some of the beverage in the first one of the containers to flow from the first one of the containers along the cascading flow path into the second one of the containers and (ii) cause at least some of the beverage in the second one of the containers to flow out of the second one of the containers into the mouth.

10. The device of claim 1, wherein the configuration of the body is a stepped configuration.

11. A beverage drinking device comprising a plurality of beverage containers, and a single-piece structure supporting all of the beverage containers in a single straight line, the single-piece structure having a configuration defining relative positions of dispensing surfaces of the plurality of beverage containers that defines a cascading flow path for a liquid to flow from a first one of the beverage containers into a second one of the beverage containers adjacent the first one of the beverage containers, wherein the first one of the beverage containers has a dispensing surface including a portion of a rim that overlaps an opening into the second one of the beverage containers and the cascading flow path includes the portion of the rim.

12. The beverage drinking device of claim 11, wherein the plurality of beverage containers are selectively separable from the single-piece structure.

13. The beverage drinking device of claim 11, wherein each beverage container includes a dispensing surface and every dispensing surface is in a different plane than all others of the dispensing surfaces.

14. The beverage drinking device of claim 11, wherein the configuration of the single-piece structure is a stepped configuration.

15. A method of using the beverage drinking device of claim 11, the method comprising:

grasping a handle portion of the single-piece structure when the first one of the beverage containers and the second one of the beverage containers are at least partially filled with a beverage;

positioning the second one of the beverage containers adjacent a mouth; and tilting the single-piece structure to simultaneously (i) cause at least some of the beverage in the first one of the beverage containers to flow from the first one of the beverage containers along the cascading flow path into the second one of the beverage containers and (ii) cause at least some of the beverage in the second one of the beverage containers to flow out of the second one of the beverage containers into the mouth.

16. A method of using a cup holder system, comprising:

a first cup holder unit including a handle, a second cup holder unit adjacent the first cup holder unit, wherein the first cup holder and the second cup holder are secured in a stepped configuration that positions a top surface of the first cup holder unit in a first plane and a top surface of the second cup holder unit in a second plane that is different than and above the first plane, and wherein the first plane is parallel to the second plane, a first cup supported by the first cup holder unit, and a second cup supported by the second cup holder unit, wherein a dispensing surface of the second cup includes a rim that is above and overhangs an adjacent portion of a rim of a dispensing surface of the first cup and defines a cascading flow path for a liquid to flow from the second cup into the first cup, the method comprising:

grasping the handle when the first cup and the second cup are at least partially filled with a beverage;

positioning the first cup adjacent a mouth; and tilting the first and second cup holder units to simultaneously (i) cause at least some of the beverage in the second cup to flow from the second cup along the cascading flow path into the first cup and (ii) cause at least some of the beverage in the first cup to flow out of the first cup into the mouth.

* * * * *